US006382416B1

(12) United States Patent
Gainey

(10) Patent No.: US 6,382,416 B1
(45) Date of Patent: May 7, 2002

(54) MEDICINE SAFETY STORAGE SYSTEM

(76) Inventor: Kathy S. Gainey, P.O. Box 221025, Charlotte, NC (US) 28222

( * ) Notice: Subject to any disclaimer, the term of this patent is extended or adjusted under 35 U.S.C. 154(b) by 35 days.

(21) Appl. No.: 09/604,023

(22) Filed: Jun. 27, 2000

(51) Int. Cl.[7] ..... B65D 85/00
(52) U.S. Cl. ..... 206/317; 206/1.5; 356/71
(58) Field of Search ..... 206/528, 534, 206/536, 533, 1.5, 807; 220/200, 210, 211, 315; 70/63, 416; 356/71

(56) References Cited

U.S. PATENT DOCUMENTS

| | | | | | |
|---|---|---|---|---|---|
| 3,973,687 | A | * | 8/1976 | Glick | 220/210 X |
| 4,653,643 | A | * | 3/1987 | Black | 206/528 |
| 4,663,621 | A | | 5/1987 | Field et al. | |
| 4,785,969 | A | | 11/1988 | Mclaughlin | |
| 5,190,185 | A | | 3/1993 | Blechl | |
| 5,377,864 | A | | 1/1995 | Blechl et al. | |
| 5,579,909 | A | | 12/1996 | Deal | |
| 5,611,051 | A | | 3/1997 | Pirelli | |
| 5,701,770 | A | | 12/1997 | Cook et al. | |
| 5,960,991 | A | | 10/1999 | Ophardt | |
| 5,971,593 | A | | 10/1999 | McGrady | |
| 5,993,046 | A | | 11/1999 | McGrady et al. | |
| 6,227,371 | B1 | * | 5/2001 | Song | 206/534 |

* cited by examiner

*Primary Examiner*—David H. Bollinger
(74) *Attorney, Agent, or Firm*—Christopher C. Dremann

(57) ABSTRACT

A medicine safety storage system restricts access to medicines to authorized persons who have pre-programmed a microprocessor to recognize their unique fingerprint. The system includes a housing portion, a cap portion and means for releasably locking the cap portion to the housing portion. The housing portion is generally hollow for holding at least one medicine container. The cap portion includes a scanner touch screen, an optical scanner and a microprocessor electrically connected to a power source. The microprocessor includes means for converting optical information relating to a fingerprint to optical fingerprint data, a permanent memory for storing the optical fingerprint data and means for comparing optical information relating to a subsequent fingerprint to the stored optical fingerprint data. The means for releasably locking the cap portion to the housing portion includes a motor electrically connected to the microprocessor and to the power source. The housing portion has at least one detent formed in the inner surface and the cap portion includes at least one locking pin fixed to the rotating shaft of the motor for engaging the at least one detent to lock the cap portion in position onto the housing portion. Preferably, the cap portion further includes a toggle switch electrically connected to the microprocessor. The toggle switch has a "record" position for reading and storing optical information relating to a fingerprint, a "secure" position for preventing the accidental recording or deleting the optical fingerprint data and a "delete" position for deleting the optical fingerprint data.

17 Claims, 6 Drawing Sheets

MEDICINE SAFETY STORAGE SYSTEM

CROSS REFERENCE TO RELATED APPLICATION (none)

FIELD OF THE INVENTION

This invention relates generally to a system for safely storing medicines that restricts access to the medicines to authorized persons. More particularly, the invention is a system for safely storing medicines that includes a fingerprint scanner for limiting access to only persons who have pre-programmed a microprocessor to recognize their unique fingerprint.

BACKGROUND OF THE INVENTION

Each year hundreds of children are accidentally poisoned by over the counter or prescription medicines found in their own homes or in the homes of relatives or friends. In response to this problem manufacturers of medicines have developed a number of medicine safety storage systems, such as child resistant packages. However, repeated tests have shown that children quickly learn to manipulate and open even the most ingenious child resistant packaging. Thus, it is apparent that there is a need for a medicine safety storage system that cannot be opened by children or other unauthorized persons.

Conventional child resistant packaging utilizes a series of sequential or simultaneous actions. The "press down and turn" medicine cap is one of the most common examples of such a system. Other common systems include the "push button and turn" and "align arrow with slot or mark and push/pull lid off" systems. These multiple action systems are designed to take advantage of the limited dexterity of children, which theoretically prevents them from manipulating the safety caps of medicine containers utilizing such systems. However, many people who take over the counter or prescription medicines, such as the elderly or disabled, likewise have limited dexterity. The multiple action systems make it difficult for these persons to gain access to their own medicines. Thus, it is apparent that there is a need for a medicine safety storage system that permits an authorized person with limited dexterity to have ready access to his or her own medicines.

When persons who take over the counter or prescription medicines are going to be away from home at the time they need to take the medicine, they must carry the medicine with them. Often such persons visit friends or relatives with children. People generally do not have a convenient, portable means for securely transporting and storing their medicines. Thus, it is apparent that there is a need for a medicine safety storage system that permits medicines to be securely transported. It is further apparent that there is a need for a medicine safety storage system that permits medicines to be securely stored while the patient is away from home.

SUMMARY OF THE OBJECTS OF THE INVENTION

It is a primary object of the invention to provide a medicine safety storage system that cannot be opened by children or other unauthorized persons.

It is a further object of the invention to provide a medicine safety storage system that permits an authorized person with limited dexterity ready access to their own medicines.

It is a further object of the invention to provide a medicine safety storage system that permits medicines to be securely transported and stored while the patient is away from home.

SUMMARY OF THE INVENTION

The above objects and others are achieved by a medicine safety storage system for restricting access to medicines to authorized persons that is constructed in accordance with the present invention. The medicine safety storage system includes a generally hollow housing portion sized to hold at least one conventionally sized medicine container, a cap portion, a power source and means for releasably locking the cap portion to the housing portion. The housing portion has inner and outer surfaces and one closed end and one open end. The cap portion is releasably lockable to the open end of the housing portion, as will be described, and has a top surface and a bottom casing, for a purpose to be described. The cap portion further includes a scanner touch screen embedded in the top surface of the cap portion, an optical scanner in optical communication with the touch screen and a microprocessor electrically connected to the optical scanner and to the power source. The microprocessor includes an optical reader for converting optical information relating to a fingerprint to optical fingerprint data, a permanent memory for storing the optical fingerprint data and conventional scanner software for comparing optical information relating to a subsequent fingerprint to the stored optical fingerprint data.

The means for releasably locking the cap portion to the housing portion includes a motor that is electrically connected to the microprocessor and to the power source. The motor includes a shaft having a first end attached to the motor and extending outwardly therefrom and a second end opposite the first end. The housing portion has at least one detent formed in the inner surface. The cap portion includes at least one locking pin that is fixed to the second end of the shaft for engaging the at least one detent formed in the inner surface of the housing portion to securely lock the cap portion in position onto the housing portion. Preferably, the cap portion further includes a toggle switch electrically connected to the microprocessor for controlling the operation of the microprocessor. The toggle switch has at least two, and preferably three, operating positions. Preferably, the toggle switch has a "record" position for reading and storing optical information relating to a fingerprint, a "secure" position for preventing the accidental recording or deleting the optical fingerprint data and a "delete" position for deleting the optical fingerprint data.

Preferably, the cap portion of the medicine safety storage system further includes a protective cover that is hingedly attached to the top surface of the cap portion. The protective cover is movable between a closed position wherein the scanner touch screen of the cap portion is protected and an open position wherein the touch screen is accessible. The protective cover is releasably locked in the closed position by a push button latch. The housing portion and the protective cover of the cap portion are made of a durable plastic material, and preferably are made of substantially transparent Plexiglas. Preferably, the medicine safety storage system further includes at least one locking peg fixed to the bottom casing of the cap portion and at least one locking peg slot provided on the inner surface of the housing portion. The locking peg slot engages the corresponding locking peg to thereby align the cap portion in position onto the housing portion. In an alternative preferred embodiment, the housing portion of the medicine safety storage is a conventional pillbox or a travel case adapted to receive the cap portion thereon.

In operation, the medicine safety storage system provides a method of safely storing at least one medicine container in the housing portion wherein the cap portion is releasably lockable to the housing portion. The method includes the steps of recording the optical fingerprint data of at least one person authorized to access the at least one medicine container within the medicine safety storage system. The method includes the further step of communicating optical information relating to a fingerprint to a microprocessor including a permanent memory for storing the optical fingerprint data and means for comparing the optical information relating to a subsequent fingerprint to the previously stored optical fingerprint data. Finally, the method includes the further step of alternately locking and unlocking the cap portion when the optical information relating to the subsequent fingerprint matches at least one of the previously stored optical fingerprint data.

BRIEF DESCRIPTION OF THE DRAWINGS

In view of the aforementioned objects and others, which will become more readily apparent as the nature of the invention is better understood, the present invention consists in the novel combination and arrangement of parts hereinafter more fully described, illustrated and claimed with reference being made to the accompanying drawings in which:

DETAILED DESCRIPTION OF THE PREFERRED EMBODIMENTS

Figure 1A:
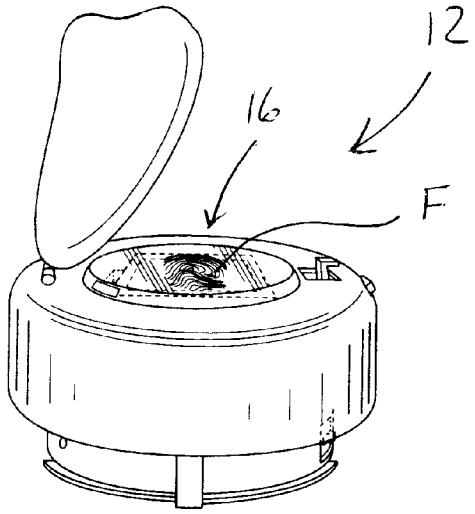
FIG. 1A is a perspective view of the cap portion of a preferred embodiment of a medicine safety storage system according to the invention.

Preferred embodiments of the invention will be described more fully hereinafter. However, the present invention should not be construed as being limited to the preferred embodiments described herein. Rather, it is intended that the invention be construed broadly to encompass any and all embodiments of a medicine safety storage system having the features disclosed herein, or equivalents thereof, which is within the skill of an ordinary person in the relevant art. In the description, like reference numerals designate like or corresponding parts throughout the several figures. It is to be also understood that such terms as "top," "bottom," "inner," "outer," "upwardly" and "downwardly" are used in the description for purposes of locating one element of the invention relative to another and are not to be construed as limiting terms. Finally, it should be understood that the illustrations provided in the accompanying figures are for the purpose of describing the various embodiments of the invention, and as such, are not intended to limit the scope of the invention in any manner.

The present invention is a medicine safety storage system for restricting access to over the counter or prescription medicines to authorized persons. Conventional medicine containers employ a number of different safety storage systems that typically require a series of sequential or simultaneous actions be completed in order to open the container to access the medicine. However, these systems only restrict access to the medicine within the container if the person attempting to open the container lacks the dexterity to perform the required actions. Many elderly or disabled patients lack the dexterity to open such medicine containers. Accordingly, such patients avoid medicine safety storage systems or immediately transfer the medicine to a container that is easily opened. The medicine is then readily accessible to children and other unauthorized persons. It is therefor desirable to provide a medicine safety storage system that permits persons with limited dexterity to readily access their own medicines while preventing access to children or other unauthorized persons. As will be described and illustrated in greater detail hereinafter, the present invention provides a medicine safety storage system that satisfies each of the above mentioned concerns.

Referring now more specifically to the accompanying drawings, the invention is a medicine safety storage system 10. The medicine safety storage system includes a cap portion 12 that is releasably lockable to a generally hollow housing portion 14. The cap portion 12 comprises a fingerprint scanner 16 to record and store the optical fingerprint data of persons authorized to have access to the medicines contained within the storage system 10 and to read the fingerprints F of persons attempting to access the medicines. The fingerprint scanner 16 is electronically connected to a microprocessor 18 that reads and stores the optical fingerprint data of authorized persons and compares the fingerprints F of persons attempting to access the medicines to the previously stored optical fingerprint data of the authorized persons. The microprocessor 18 comprises a scanner chip, a permanent memory and conventional scanner software to perform various functions, including storing optical fingerprint data and comparing fingerprints F read by the scanner 16 to the stored optical fingerprint data. When a fingerprint F read by the scanner 16 matches stored optical fingerprint data, the microprocessor 18 sends an electrical signal to a small motor 20 located in the cap portion 12. The motor 20 turns a shaft 22 to rotate a pair of metal locking pins 24 between a locked position and an unlocked position to alternately secure and release the cap portion 12 to and from the housing portion 14, respectively, of the medicine safety storage system 10.

Figure 1B:
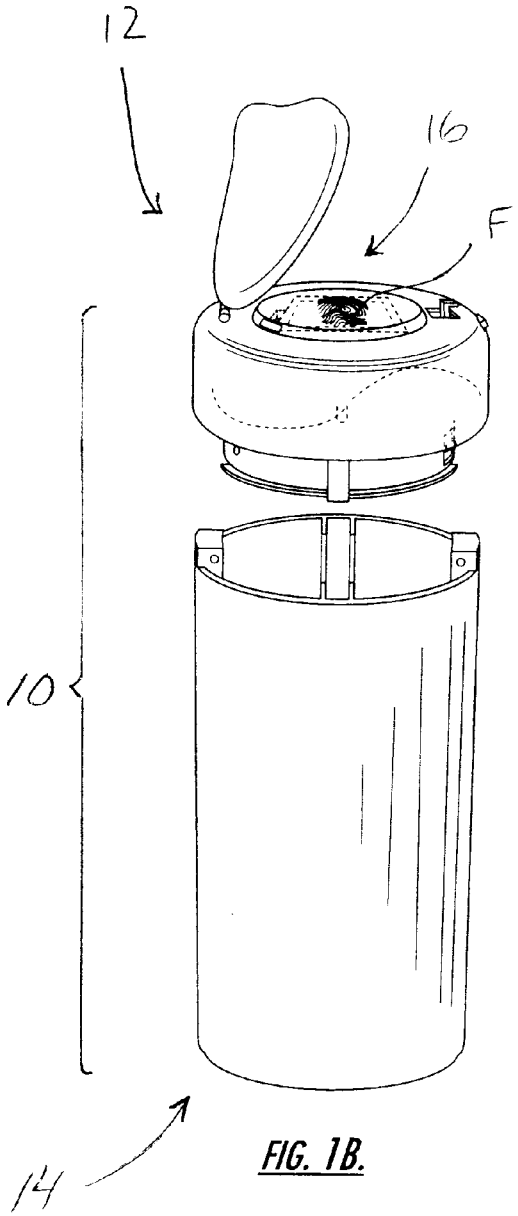
FIG. 1B is a perspective view showing the cap portion of FIG. 1A removed from the housing portion of a medicine safety storage system according to the invention.
Figure 1C:
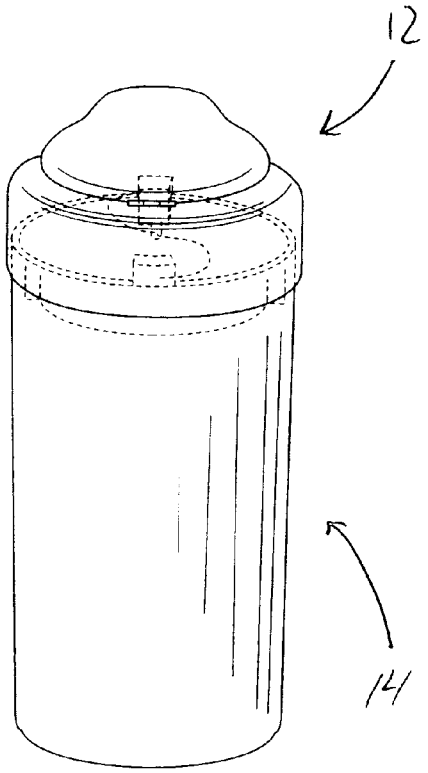
FIG. 1C is a perspective view of the medicine safety storage system of FIG. 1B showing the cap portion secured to the housing portion.
Figure 5A:
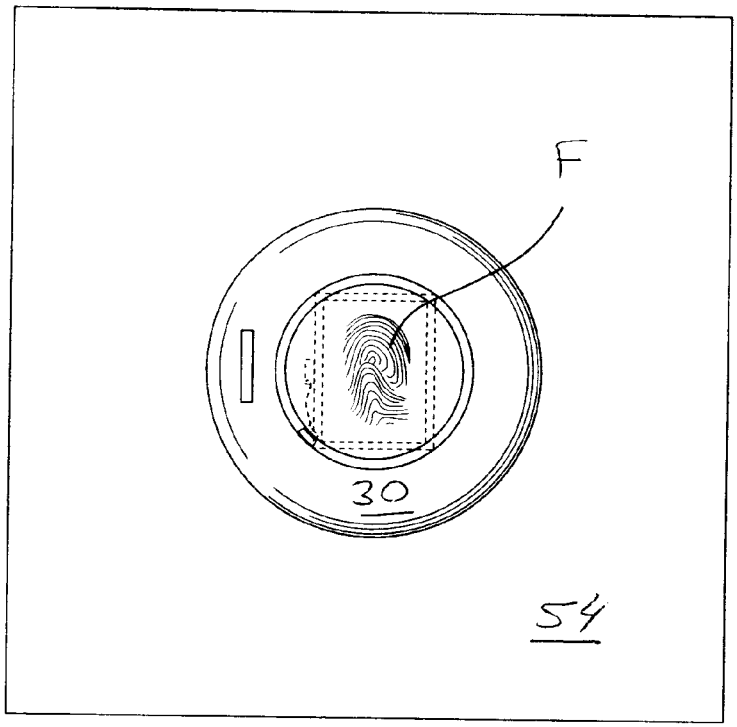
FIG. 5A is a plan view of an alternative preferred embodiment of a medicine safety storage system according to the invention.
Figure 5B:
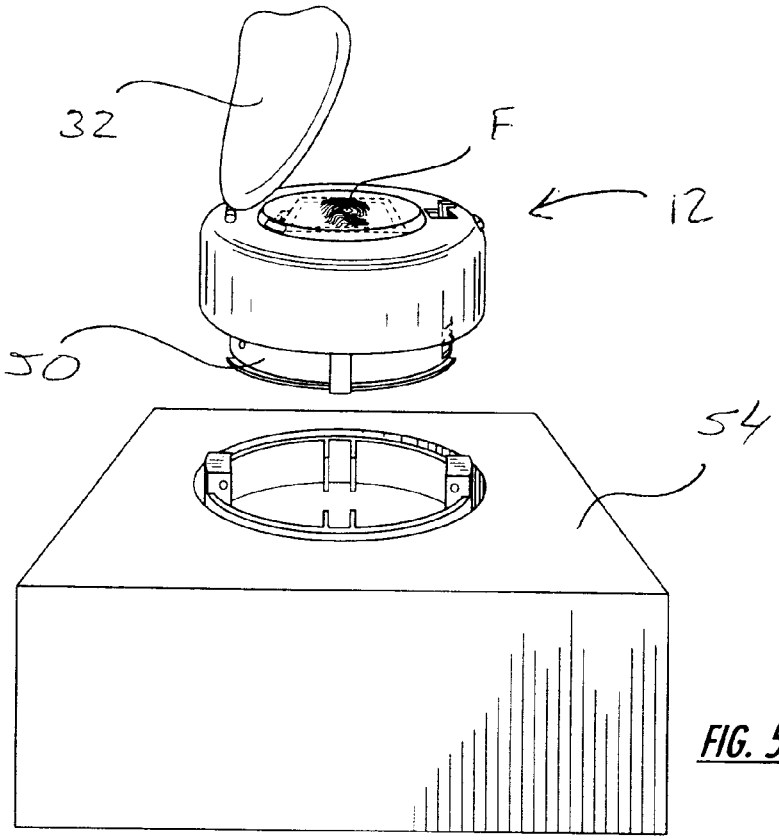
FIG. 5B is an elevation view of the medicine safety storage system of FIG. 5A.

FIGS. 1A–1C provide perspective views of a preferred embodiment of a medicine safety storage system according to the invention that illustrate the relationship between the cap portion 12 and the housing portion 14. The housing portion 14 is generally hollow and is preferably cylindrical in shape. The housing portion 14 has one closed end and one open end onto which the cap portion 12 is positioned to cover the housing portion 14. The housing portion 14 is sized to hold at least one, and preferably two or more, conventionally sized medicine containers C. The housing portion 14 is sized and constructed to be conveniently portable and sufficiently durable to withstand the normal abuses encountered during transportation. The housing portion 14 may be constructed of various kinds of plastic and preferably is substantially transparent to permit the labels on the medicine containers C stored within the medicine safety storage system 10 to be read. As illustrated by the alternative preferred embodiment shown in FIGS. 5A and 5B, the cap portion 12 can also be used with larger housings 54, such as pillboxes or travel cases, to restrict access to the medicine containers C housed therein to authorized persons.

Figure 3A:
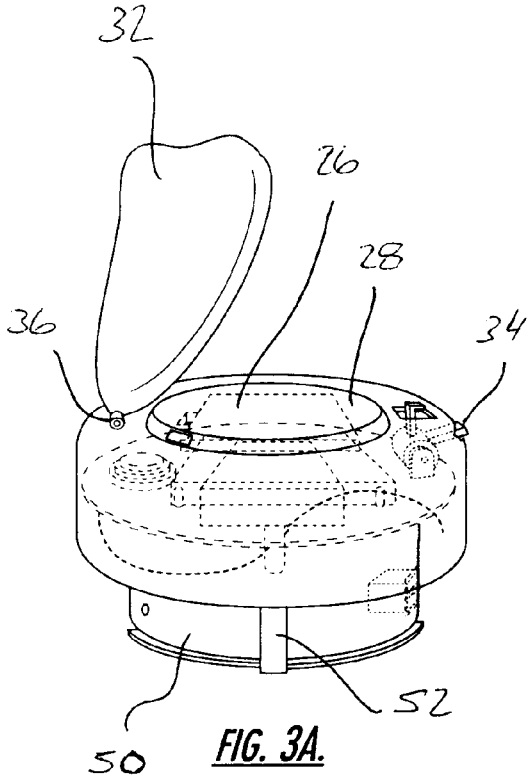
FIG. 3A is a perspective view of the cap portion of the medicine safety storage system of FIG. 2 with the internal parts indicated by phantom lines.
Figure 3B:
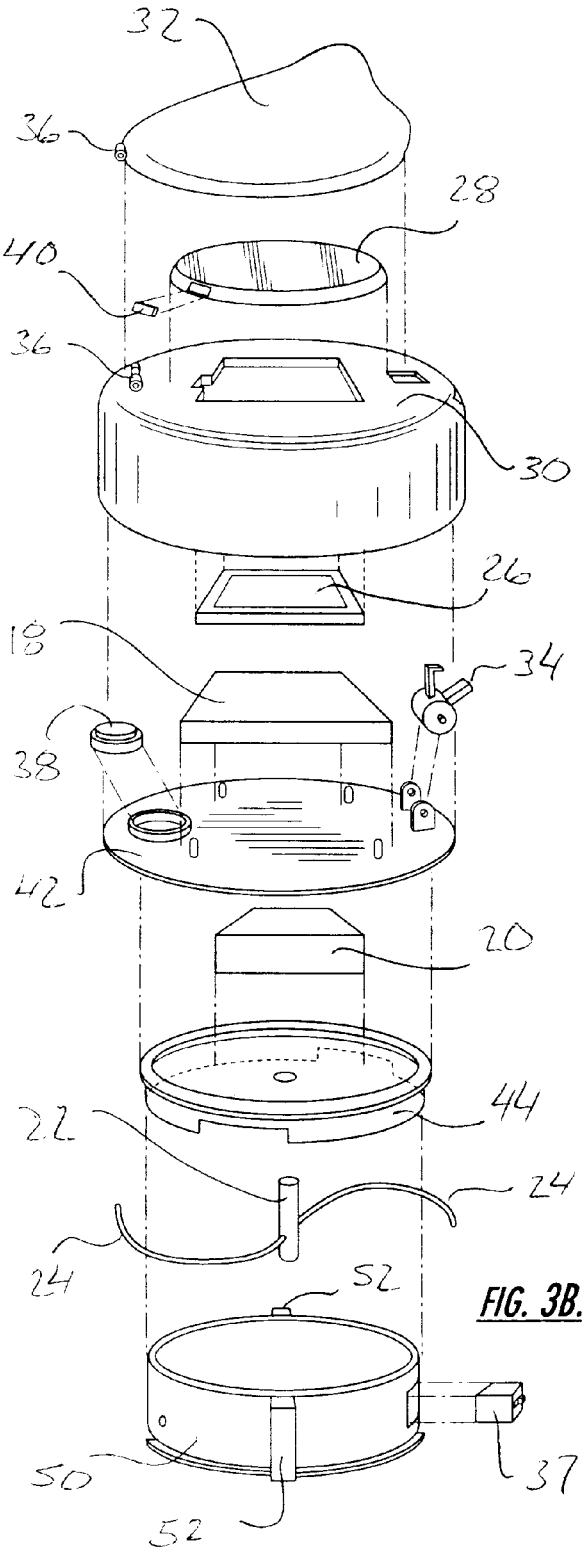
FIG. 3B is an exploded view of the cap portion of FIG. 3A.
Figure 3C:
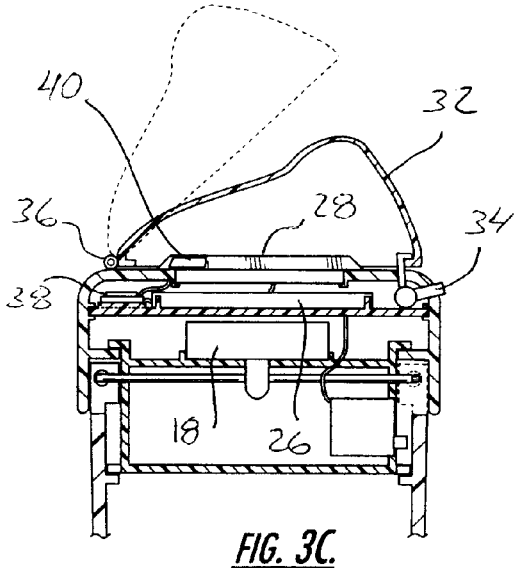
FIG. 3C is a sectional view of the cap portion of FIG. 3A with the lid covering the scanner in the open position indicated by phantom lines.
Figure 3D:
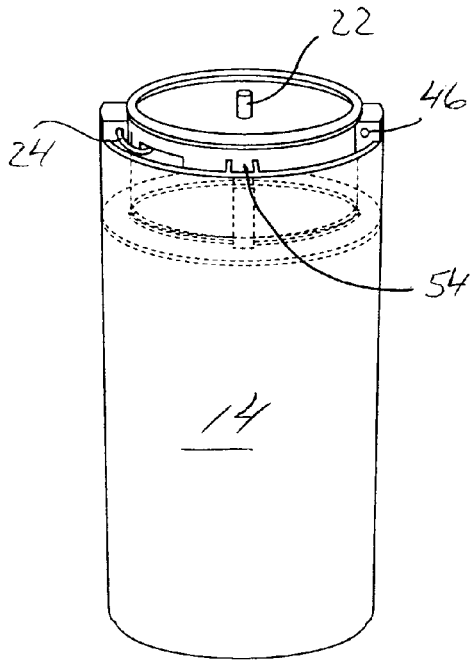
FIG. 3D is a perspective view of the housing portion of the medicine safety storage system of FIG. 2 with the internal parts indicated by phantom lines.

As best shown in FIGS. 3A–3C, the cap portion 12 contains a computerized locking mechanism. The computerized locking mechanism comprises a fingerprint scanner 16, a microprocessor 18 and means for releasably locking the cap portion 12 to the housing portion 14. The fingerprint scanner 16 comprises an optical reader 26 in optical communication with a touch screen 28 embedded in the top surface 30 of the cap portion 12. The scanner touch screen 28 is preferably made of a substantially transparent, scratch resistant and durable plastic material, such as Plexiglas. Preferably, a protective cover 32 is positioned over the scanner touch screen 28 to protect the touch screen 28 when it is not in use. The protective cover 32 is locked in the closed position by a miniature push button latch 34. A hinge 36 permits the protective cover 32 to alternately move between the closed position that protects the scanner touch screen 28 and the open position that provides access to the touch screen 28. Preferably, the latch 34 is a looped latch lock such that the user must push the button 34 and lift the protective cover 32 at the same time to unlock the protective cover 32. In order to fulfill the objects of this invention, the latch 34 locking the protective cover 32 must permit authorized persons with limited dexterity to open the latch easily. Otherwise, the protective cover 32 must be removable. Since an authorized fingerprint F is required to access the medicine containers C stored within the housing portion 14 of the medicine safety storage system 10, an unauthorized person, and in particular an unauthorized child, will not be able to access the medicine containers C even though access to the scanner touch screen 28 is possible.

Figure 2:
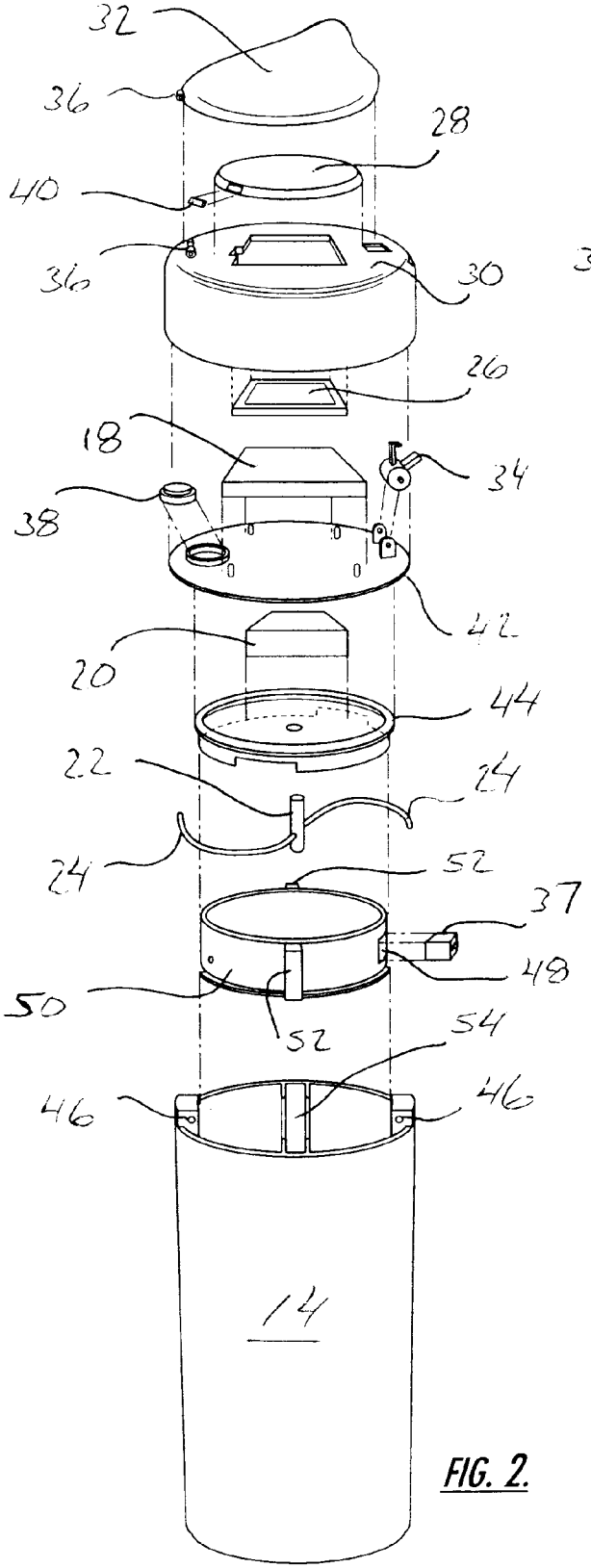
FIG. 2 is an exploded view of the medicine safety storage system of FIG. 1C.

The microprocessor 18 is electrically connected to the optical reader 26 and to a toggle switch 37 located within the cap portion 12 to enable an authorized person to record, store and delete optical fingerprint data and to ready the medicine safety storage system 10 for subsequent use. The microprocessor 18 is also electrically connected to the means for releasably locking the cap portion 12 to the housing portion 14 of the medicine safety storage system 10. In the preferred embodiment of the cap portion 12 disclosed herein, the means for releasably locking the cap portion 12 to the housing portion 14 comprises a motor 20, a motor shaft 22 and a pair of curved, radially extending locking pins 24. Preferably, the pair of locking pins 24 is defined by a small diameter, generally "S" shaped rod as best shown in FIGS. 2 and 4. The microprocessor 18 is electrically connected to the motor 20 and the microprocessor 18 and the motor 20 are each electrically connected to a power source. Preferably, the power source is a photocell 38 (e.g., solar cell) that stores electrical power converted from light energy entering the cap portion 12 through a window 40 provided in the scanner touch screen 28 on the top surface 30 of the cap portion 12. A small battery, such as a watch battery, may also serve as the power source. Preferably, the power source has a conventional "power save" or "sleeper" mode for conserving power when the protective cover 32 is closed, and thus, the motor 20 and the microprocessor 18 are not in use. As will be appreciated by those skilled in the art, removing the protective cover 32 from the cap portion 12 to provide ready access to the scanner touch screen by authorized persons with limited dexterity will disable the "power save" or "sleeper" feature. The microprocessor 18 and photocell 38 are mounted on a divider 42 that anchors the microprocessor 18 and the photocell 38 to the inside of the cap portion 12. The divider 42 preferably has a small opening formed therethrough to provide airflow circulation for cooling the microprocessor 18 and the photocell 38.

Figure 4B:
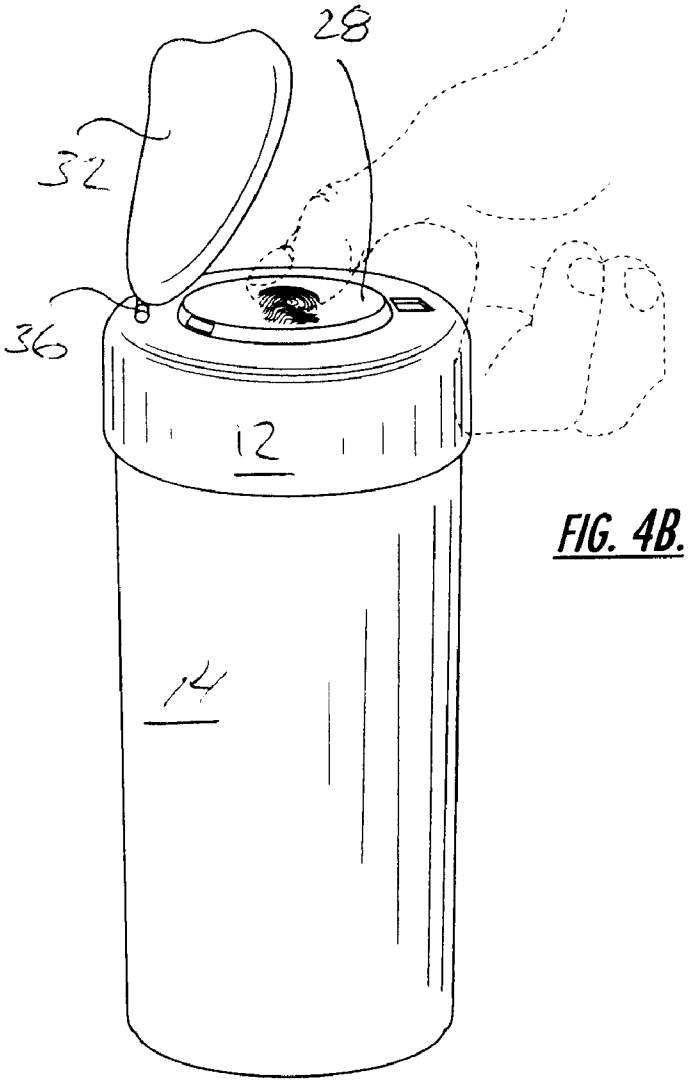
FIG. 4B illustrates a fingerprint being acknowledged by the microprocessor of the cap portion of the medicine safety storage system of FIG. 2.
Figure 4A:
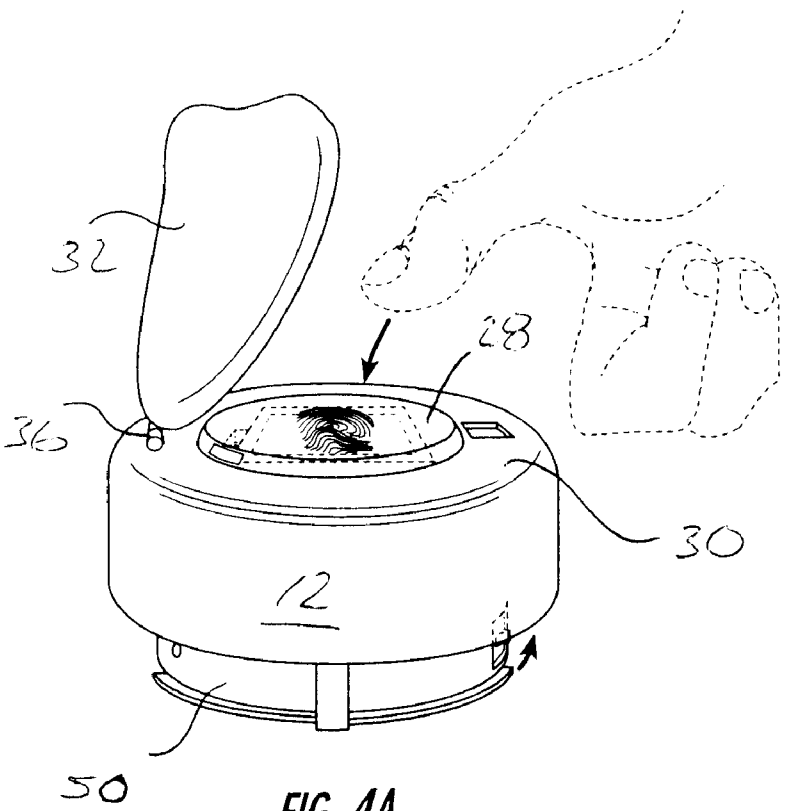
FIG. 4A illustrates a fingerprint being recorded and stored in the microprocessor of the cap portion of the medicine safety storage system of FIG. 2.
Figure 4D:
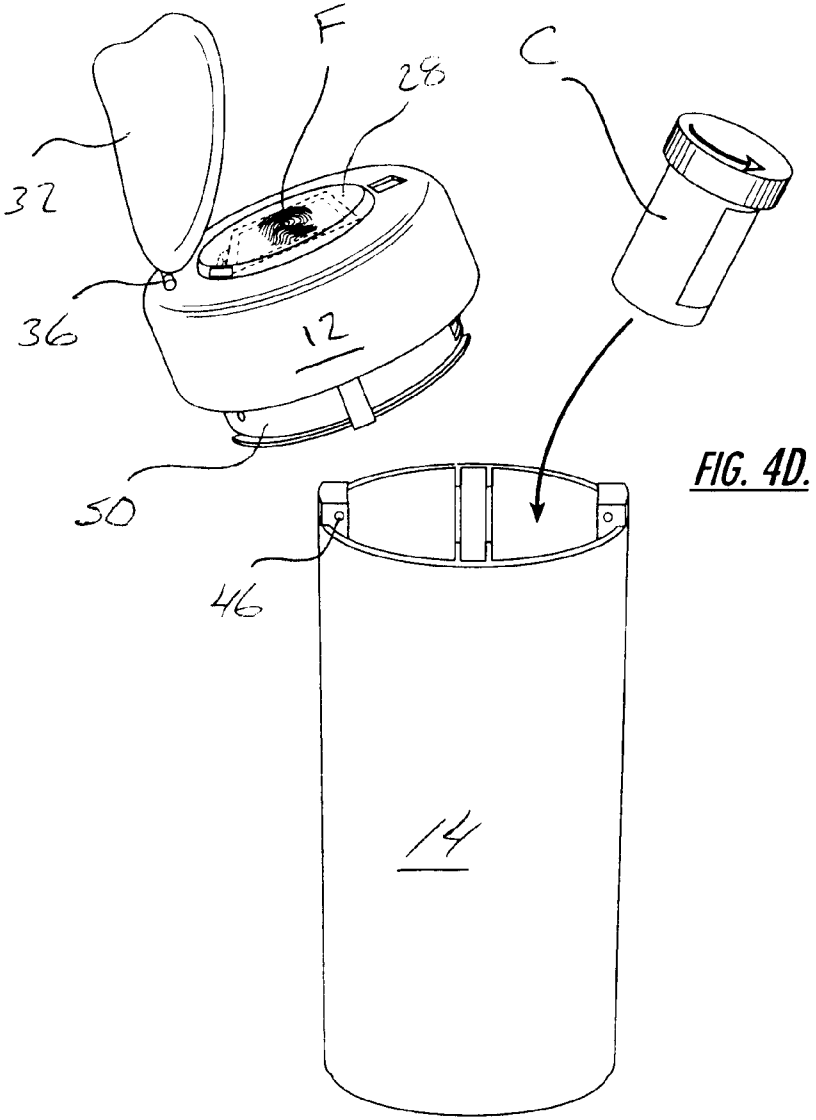
FIG. 4D illustrates the placement of a conventional medicine container into the housing portion of the medicine safety storage system of FIG. 2.
Figure 4C:
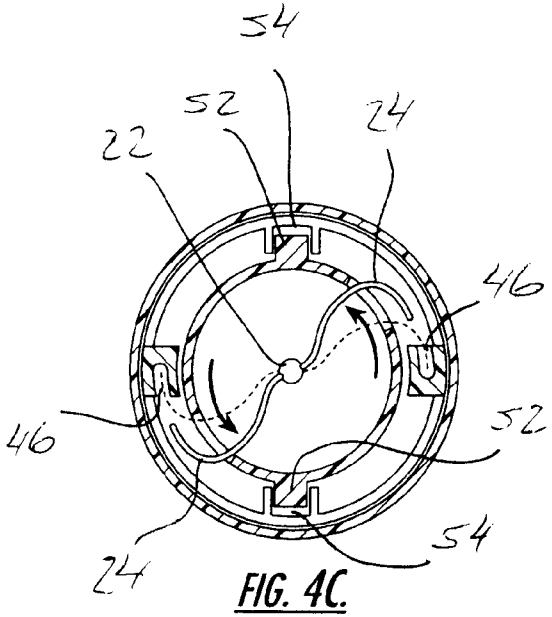
FIG. 4C illustrates the locking pins of the cap portion of the medicine safety storage system of FIG. 2 being turned from the locked position to the unlocked position.

The motor 20 is mounted in the center of the cap portion 12 on a plastic shelf 44 positioned below the divider 42. The motor 20 controls the movement of the shaft 22, and thus, the means for releasably locking the cap portion 12 on the housing portion 14. The shaft 22 extends vertically downwardly from the motor 20 through the shelf 44. The "S" shaped locking pins 24 are fixed to the end of the shaft 22. The shaft 22 rotates the locking pins 24 between a locked position wherein the locking pins 24 are extended and received in a pair of detents 46 provided in the sidewall of the housing portion 14 to secure the cap portion 12 on the housing portion 14 and an unlocked position wherein the locking pins 24 are recessed to permit the cap portion 12 to be removed from the housing portion 14. The locking pins 24 are sufficiently curved so that the locking pins 24 are fully recessed in the unlocked position. Thus, the locking pins 24 will not become snagged or damaged when the cap portion 12 is removed from or replaced onto the housing portion 14. As best shown in FIG. 4C, the locking pins 24 rotate clockwise from the unlocked position to the locked position and counterclockwise from the locked to the unlocked position. Preferably, the locking pins 24 rotate no more than about forty-five (45) degrees in either the clockwise or counterclockwise directions. If necessary, however, the locking pins 24 may rotate as much as about ninety (90) degrees so that the locking pins 24 are completely recessed in the unlocked position.

Preferably, stationary locking pegs 52 are fixed to the outside of the bottom casing 50 of the cap portion 12. The locking pegs 52 engage corresponding locking peg slots 54 provided on the inner surface of the housing portion 14. The locking pegs 52 and peg slots 54 ensure that the locking pins 24 will engage the locking pin detents 46 formed on the inside surface of the housing portion 14 when the cap portion 12 is positioned onto the housing portion 14. The locking peg slots 54 are preferably located at the 12 o'clock and the 6 o'clock positions while the locking pin detents 46 are located at the 3 o'clock and the 9 o'clock positions. Markings are provided on the outside of the cap portion 12 and the outside of the housing portion 14 to enable the user to readily align the locking peg slots 54 and locking pegs 52.

As previously mentioned, a toggle switch 37 is located within the cap portion 12 to enable an authorized person to record and to store and delete optical fingerprint data in the permanent memory of the microprocessor 18 to ready the medicine safety storage system 10 for subsequent use. A relatively small opening 48 formed in the bottom casing 50 of the cap portion 12 provides access to the toggle switch 37. A small diameter instrument, such as the tip of a pen or pencil, can be used to move the toggle switch 37 to the desired position. Markings are printed on the outside of the bottom casing 50 of the cap portion 12 to indicate the function of each position of the toggle switch 37. When the toggle switch 37 is in the "record" position, optical fingerprint data of authorized persons may be entered into the permanent memory of the microprocessor 18. Placing the toggle switch 37 in the "secure" position readies the medicine safety storage system 10 for the functions of receiving optical information relating to a fingerprint F, comparing the fingerprint F to the optical fingerprint data of authorized persons stored in the permanent memory of the microprocessor 18, and then unlocking the cap portion 12 to permit the authorized person to remove the cap portion 12 from the housing portion 14 to obtain access to the medicine containers C or locking the cap portion 12 to the housing portion 14 again to securely store the medicine containers C within the medicine safety storage system 10.

Placing the toggle switch 37 in the "delete" position permits the optical fingerprint data of persons that are no longer authorized to access the medicine containers C within the medicine safety storage system 10 to be deleted from the permanent memory of the microprocessor 18. For simplicity and reliability, the microprocessor 18 is programmed to perform only the lock or unlock function when the toggle switch 37 is in the "secure" position. This feature prevents the inadvertent recording or deleting of optical fingerprint data. Because the cap portion 12 is programmed to only lock or unlock, it is unnecessary to provide a switch for an authorized person to lock or unlock the cap portion 12. The microprocessor 18 of the cap portion 12 simply performs the next function each time the fingerprint F of an authorized person is read by the optical scanner 26 and recognized by the microprocessor 18.

In accordance with the objects of the invention, the medicine safety storage system is simple to operate and requires very little manual dexterity to obtain access to the medicine containers C within the medicine safety storage system 10. The first step in using the medicine safety storage system 10 is to record the optical fingerprint data of persons authorized to access the medicine containers C within the housing portion 14. The authorized person utilizes a small diameter instrument, such as the tip of a pen or a pencil, to place the toggle switch 37 in the "record" position. The authorized person then presses his or her thumb or finger against the scanner touch screen 28 (FIG. 4A). To access the scanner touch screen 28, the authorized person must simultaneously press the latch lock 34 and lift the protective cover 32. Once the protective cover 32 is lifted to the open position, the scanner touch screen 28 is accessible. The optical scanner 26 scans the fingerprint F and communicates the data to the microprocessor 18 where the optical fingerprint data of the authorized person is stored in the permanent memory of the microprocessor 18. The authorized person then utilizes the small diameter instrument to place the toggle switch 37 in the "secure" position.

When an authorized person desires to remove the cap portion 12 from the housing portion 14 of the medicine safety storage system 10, he or she again lifts the protective cover 32 to the open position to access the scanner touch screen 28. The authorized person then presses his or her finger or thumb against the scanner touch screen 28 and the optical scanner 26 communicates the optical information relating to the fingerprint F to the microprocessor 18 (FIG. 4B). The microprocessor 18 compares the optical information relating to the fingerprint F to the optical fingerprint data stored in the permanent memory of the microprocessor 18. If the fingerprint F does not match any of the optical fingerprint data stored in the permanent memory, the microprocessor 18 does nothing. If the fingerprint F matches one of the optical fingerprint data, the microprocessor 18 sends an electrical signal to the motor 20 to rotate the shaft 22, thereby rotating the locking pins 24 in the counterclockwise direction. As the locking pins 24 rotate counterclockwise, they disengage from the locking pin detents 46 and recess into the cap portion 12 so that the cap portion 12 may be removed from the housing portion 14. Once the cap portion 12 is removed from the housing portion 14, the medicine containers C may be placed in the housing portion 14 (FIG. 4D) to be safely and securely stored within the medicine safety storage system 10.

The cap portion 12 is repositioned on the housing portion 14 by aligning the markings on the outside surfaces of the cap portion 12 with the corresponding markings on the outside surface of the housing portion 14 so that the locking pegs 52 engage the locking pegs slots 54. The cap portion 12 is then lowered downwardly into position onto the housing portion 14. To lock the cap portion 12 into place, the authorized person presses his or her finger or thumb against the scanner touch screen 28. The scanner touch screen 28 communicates the optical information relating to the fingerprint F to the microprocessor 18, which then sends an electrical signal to the motor 20 to rotate the shaft 22 in the clockwise direction, thereby engaging the "S" shaped locking pins 24 in the locking pin detents 46. The medicine containers C placed within the housing portion 14 of the medicine safety storage system 10 are then securely stored until an authorized person places his or her finger against the scanner touch screen 28 to unlock the cap portion 12.

If the patient decides that he or she no longer desires an authorized person whose optical fingerprint data is stored in the permanent memory of the microprocessor 18 to have access to the medicine containers C, that person's optical fingerprint data may be deleted from the memory of the microprocessor 18. First, the patient utilizes a small diameter instrument, such as the tip of a pen or pencil, to place the toggle switch 37 in the "delete" position. The person whose optical fingerprint data is to be deleted presses his or her finger or thumb against the scanner touch screen 28. The optical information relating to the fingerprint F of that person is communicated to the microprocessor 18 where the fingerprint F is compared to the stored optical fingerprint data. The matching data is then deleted from the memory of the microprocessor 18 and that person no longer has access to the medicine containers C stored within the medicine safety storage system 10. Once the optical fingerprint data is deleted, the patient utilizes the small diameter instrument to again place the toggle switch 37 in the "secure" position, thereby readying the medicine safety storage system 10 for use, as previously described.

While certain representative embodiments and details have been shown for purposes of illustrating the invention, it will be apparent to those skilled in the art that various changes in the form and detail of the invention may be made without departing from the spirit and scope of the invention as defined by the appended claims. In particular, one of ordinary skill in the art will readily appreciate that the disclosed cap portion may be adapted for use with conventionally sized over the counter and prescription medicine bottles. In this manner, the cap portion may be offered as a replacement for conventional medicine bottle caps to be used with a medicine bottle equipped with one or more detents for receiving one or more locking pins provided on the underside of the cap portion.

That which is claimed is:

1. A medicine safety storage system for restricting access to medicines to authorized persons, said system comprising:

a generally hollow housing portion having inner and outer surfaces and one closed end and one open end;

a cap portion releasably lockable to the open end of said housing portion, said cap portion having a top surface and a bottom casing, said cap portion comprising;

a scanner touch screen embedded in said top surface of said cap portion;

an optical scanner in optical communication with said touch screen; and a microprocessor electrically connected to said optical scanner, said microprocessor comprising means for converting optical information relating to a fingerprint to optical fingerprint data, a permanent memory for storing the optical fingerprint data and means for comparing optical information relating to a subsequent fingerprint to the stored optical fingerprint data;

a power source electrically connected to said microprocessor; and means for releasably locking said cap portion to said housing portion.

2. A medicine safety storage system according to claim 1 wherein said housing portion has at least one detent formed in said inner surface and wherein said means for releasably locking said cap portion to said housing portion comprises:

a motor electrically connected to said microprocessor and to said power source;

a shaft extending from said motor and having a first end attached to said motor and a second end; and at least one locking pin fixed to said second end of said shaft, said at least one locking pin engaging said at least one detent formed in said inner surface of said housing portion.

3. A medicine safety storage system according to claim 2 wherein said motor rotates said at least one locking pin about said shaft no more than about forty-five (45) degrees.

4. A medicine safety storage system according to claim 1 wherein said cap portion further comprises:

a toggle switch electrically connected to said microprocessor for controlling the operation of said microprocessor, said toggle switch having at least two positions.

5. A medicine safety storage system according to claim 4 wherein said toggle switch comprises a "record" position for reading and storing optical information relating to a fingerprint, a "secure" position for preventing the accidental recording or deleting the optical fingerprint data and a "delete" position for deleting the optical fingerprint data.

6. A medicine safety storage system according to claim 1 wherein said cap portion further comprises:

a protective cover hingedly attached to said top surface of said cap portion, said protective cover movable between a closed position wherein said touch screen is protected and an open position wherein said touch screen is accessible.

7. A medicine safety storage system according to claim 6 wherein said protective cover is releasably locked in the closed position by a push button latch.

8. A medicine safety storage system according to claim 6 wherein said housing portion and said protective cover is made of a durable plastic material.

9. A medicine safety storage system according to claim 8 wherein said protective cover is made of Plexiglas.

10. A medicine safety storage system according to claim 1 further comprising:

at least one locking peg fixed to said bottom casing of said cap portion; and at least one locking peg slot provided on said inner surface of said housing portion for engaging said at least one locking peg and thereby align said cap portion onto said housing portion.

11. A medicine safety storage system according to claim 1 wherein said means for converting optical information relating to a fingerprint comprises an optical reader and wherein said means for comparing optical information relating to a subsequent fingerprint comprises conventional optical scanner software.

12. A medicine safety storage system according to claim 1 wherein said housing portion is made of a substantially transparent material.

13. A medicine safety storage system according to claim 1 wherein said housing portion is sized to hold at least one conventionally sized medicine container.

14. A medicine safety storage system according to claim 1 wherein said housing portion is selected from the group consisting of a pillbox and a travel case.

15. A medicine safety storage system according to claim 1 wherein said power source is selected from the group consisting of a photocell, a solar cell and a watch battery.

16. A method of safely storing at least one medicine container in a medicine safety storage system according to claim 1, the method comprising the steps of:

recording the optical fingerprint data of at least one person authorized to access the at least one medicine container within the medicine safety storage system;

communicating optical information relating to a fingerprint to the microprocessor;

comparing the optical information relating to the fingerprint to the previously recorded optical fingerprint data; and alternately locking and unlocking the cap portion when the optical information relating to the fingerprint matches the previously recorded optical fingerprint data.

17. A method of safely storing at least one medicine container in a medicine safety storage system according to claim 1, the method comprising the steps of:

recording and storing optical fingerprint data of at least one person authorized to access the at least one medicine container within the medicine safety storage system;

communicating optical information relating to a fingerprint of a person to the microprocessor;

comparing the optical information relating to the fingerprint of the person to the recorded and stored optical fingerprint data; and unlocking the cap portion when the optical information relating to the fingerprint of the person matches the recorded and stored optical fingerprint data.

* * * * *